US006065929A

United States Patent [19]

Morel et al.

[11] Patent Number: 6,065,929

[45] Date of Patent: May 23, 2000

[54] INDUCER EQUIPMENT FOR A PUMP HAVING LARGE INDUCTION CAPACITY

[75] Inventors: Philippe Morel, Courcelles sur Seine; Philippe Geai, Aubevoye; Noël David, Breuilpont, all of France

[73] Assignee: Societe Nationale D'Etude et de Construction de Moteurs D'Aviation, Paris, France

[21] Appl. No.: 09/109,974

[22] Filed: Jul. 2, 1998

[30] Foreign Application Priority Data

Apr. 7, 1997 [FR] France ..... 97 08481

[51] Int. Cl.[7] ..... F04D 13/12

[52] U.S. Cl. ..... 415/173.1; 415/222; 415/223

[58] Field of Search ..... 415/173.1, 143, 415/222, 170.1, 914, 221, 223, 199.6

[56] References Cited

U.S. PATENT DOCUMENTS

| | | | |
|---|---|---|---|
| 4,375,937 | 3/1983 | Cooper | 415/53 R |
| 4,426,190 | 1/1984 | Shapiro et al. | 415/74 |
| 4,721,435 | 1/1988 | Kuah | 415/143 |
| 4,900,222 | 2/1990 | Meng et al. | 415/143 |

FOREIGN PATENT DOCUMENTS 28 54 656 7/1980 Germany .

5-332300 12/1993 Japan .

OTHER PUBLICATIONS

"Hydraulic and Mechanical Performance of LE–7 and LOX Pump Inducer" *Journal of Propulsion and Power*, vol. 9, No. 6, Nov.–Dec. 1993.

*Primary Examiner*—Edward K. Look
*Assistant Examiner*—Rhonda Barton
*Attorney, Agent, or Firm*—Weingarten, Schurgin, Gagnebin & Hayes LLP

[57] ABSTRACT

Inducer equipment adapted to a pump having large induction capacity which includes a case surrounding an inducer rotor having a plurality of blades leaving clearance relative to the case. The clearance between the peripheral portions of the blades and the case is of an increased value greater than the value of the normal clearance over a zone which extends both into a cylindrical first portion of the inside wall of the case upstream from the inducer rotor and into a portion of the inside wall of the case adjacent to the cylindrical first portion and overlapping an upstream portion of the inducer rotor over a distance from the leading edges of the blades of the inducer rotor. The ratio between the clearance of increased value and the clearance of normal value is advantageously greater than 10.

4 Claims, 6 Drawing Sheets

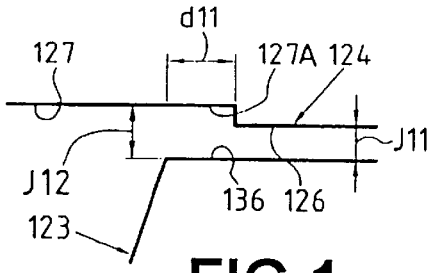
FIG.1
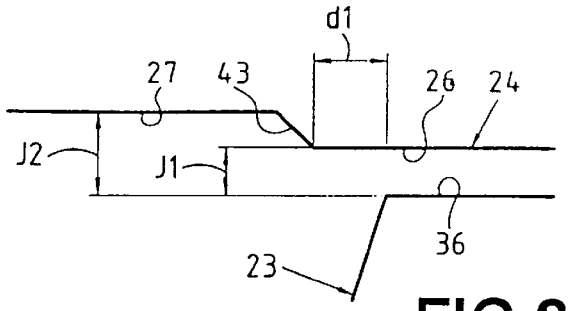
PRIOR ART FIG.2
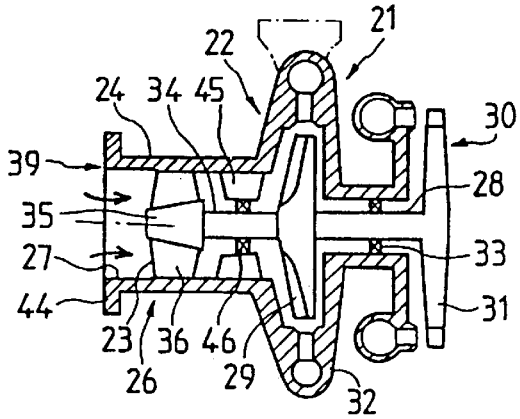
FIG.3
PRIOR ART
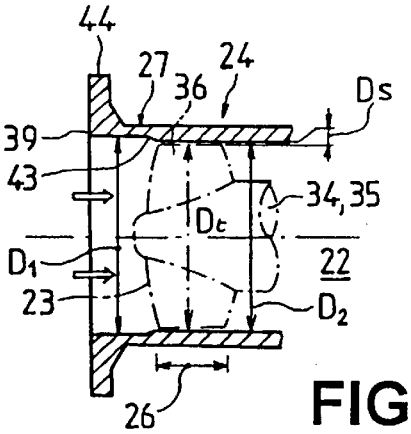
FIG.4
PRIOR ART
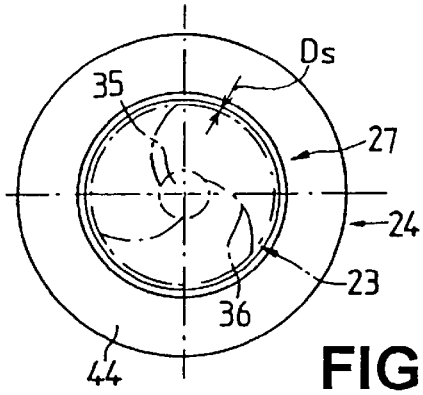
FIG.5
PRIOR ART
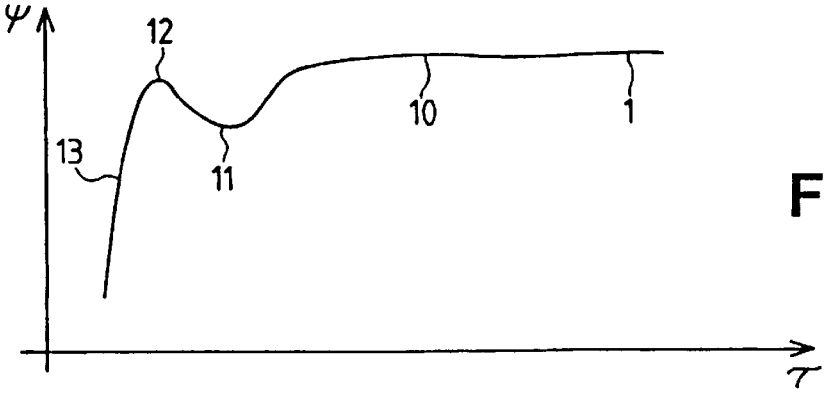
FIG.6

INDUCER EQUIPMENT FOR A PUMP HAVING LARGE INDUCTION CAPACITY

FIELD OF THE INVENTION

The present invention relates to inducer equipment for a large induction-capacity pump including a case surrounding an inducer rotor having a plurality of blades leaving clearance relative to the case.

PRIOR ART

Various types of pump having large induction capacity, or turbopumps, are already known that are intended in particular for pressurizing cryogenic liquids, such as the propellant components fed to rocket engines.

Such pumps are fitted with a first inlet rotor element known as an "inducer".

When the inducer of a turbopump operates at relatively high flowrate coefficients, then a phenomenon of supersynchronous cavitation is encountered.

Using $\phi$ to designate the flowrate coefficient of the machine, and $\phi_0$ to designate the flowrate coefficient corresponding to the matched point of the inducer (i.e. circumstances where the flow enters into the inducer at a mean angle equal to that between the blading and the case of the machine), various inducers of European, American, and Japanese origin already operate at flowrates $\phi/\phi_0$ close to 0.6. In this working zone, a phenomenon of supersynchronous cavitation is encountered. This phenomenon is present in particular with the inducer for the liquid hydrogen turbopump associated with the VULCAIN 1 rocket engine, and also with the inducer for the liquid oxygen turbopump associated with the same VULCAIN 1 rocket engine.

Thus, when the inlet pressure to the inducer is lowered, a rotary cavitation phase is observed which gives rise to large amounts of vibration and to radial forces on the shaft. That type of cavitation is due to the liquid vaporizing in different manners in the various bladed passages of the inducer. The amplitude of said vibration is predominant at a supersynchronous frequency $F_s$ which is about 1.2 times the frequency of rotation $F_0$ of the machine, which supersynchronous frequency Fs moves progressively towards the synchronous frequency $F_0$ as the feed pressure to the inducer is progressively decreased.

FIG. 6 is a diagrammatic graph in which there can be seen a curve 1 of $\psi=f(\tau)$ where $\psi$ represents the dimensionless pressure rise of the inducer and $\tau$ represents the dimensionless inlet pressure of the inducer.

It can be seen that this curve 1 has a more or less horizontal portion 10, and that with decreasing $\tau$ it has a zone having a dip 11 and a rise 12 which correspond to the zone having the rotary cavitation phase. Between the rise 12 and the dip 11, there exists a zone in which the slope of the curve defined by $d\psi/d\tau$ is negative. In this zone, the entire system comprising the lines and the pump is destabilized. The portion 13 of the curve corresponds to the drop in pressure rise provided by the inducer when the value of $\tau$ becomes too small.

Proposals have already been made, in particular in published Japanese patent application No. 5-332300, to modify the shape of the case of the pump in the vicinity of the inducer in an attempt to get rid of the supersynchronous frequency. Thus, as shown in FIGS. 2 and 4, the inside diameter of the front portion 24 of the case tapers progressively along an inclined portion 43 upstream from the blades 36 of the inducer rotor 23 so as to present a diameter D2 in a zone 26 that is smaller than the diameter D1 of the inside wall of the portion 27 of the case situated upstream from the inducer, the diameter D2 remaining greater than the diameter Dt of the rotor 23 so as to leave clearance J1 between the inside cylindrical wall of the case 24 in the zone 26 and the rotor 23 of the inducer. The clearance J2 which exists between the diameter Dt of the rotor 23 and the portion 27 of the case of diameter D1 is thus greater than the clearance J1 which exists between the rotor 23 and the zone 26 of the case, and extends over a short distance d1 upstream from the rotor of the inducer 23. In that prior art, the clearance J2 is about twice the clearance J1. Nevertheless, tests have shown that making an enlarged portion of the inside diameter of the case upstream from the rotor under such conditions is insufficient to guarantee under all circumstances that there is no rotary cavitation and that the supersynchronous frequency is eliminated.

The solution recommended in Japanese patent application JP-A-5 332 300 is therefore not certain to eliminate vibration caused by the rotary cavitation phenomenon relative to the case or relative to the rotor. As a result, there remains a risk of pump components, such as its bearings, being damaged and a risk that the pressure of the liquid at the inlet to the pump must remain above a minimum value below which the phenomenon of rotary cavitation might reappear. Unfortunately, it is desirable to reduce the pressure of the liquid at the inlet to the pump so that the pressure of the liquid on board a rocket and stored in a tank can be as low as possible, thereby making it possible to lighten and simplify the mechanical structure of the tank storing the liquid and associated with the pump that is provided with an inducer.

OBJECT AND BRIEF SUMMARY OF THE INVENTION

The present invention seeks to remedy the above-mentioned drawbacks and to provide inducer equipment for a high induction-capacity pump in which the supersynchronous frequency is eliminated over the entire operating flowrate range of the inducer so as to avoid the phenomenon of supersynchronous cavitation and reduce any risks of high amplitude vibration appearing.

These objects are achieved by inducer equipment for a large induction-capacity pump including a case surrounding an inducer rotor having a plurality of blades leaving clearance relative to the case, wherein the clearance between the peripheral portion of the blades and the case has an increased value greater than the value of the normal clearance over a zone which extends both in a cylindrical first portion of the inside wall of the case upstream from the inducer rotor and over a portion of the inside wall of the case adjacent to said cylindrical first portion and covering an upstream portion of the inducer rotor over a distance from the leading edges of the blades of the inducer rotor, and wherein the ratio between the clearance of increased value and the clearance of normal value is greater than 10.

The clearance of normal value has a value lying in the range 0.4% to 1% of the radius of the peripheral portions of the blades of the inducer.

By way of example, the clearance of normal value has a value lying in the range 0.4 mm to 0.9 mm, while the clearance of increased value has a value lying in the range 5 mm to 10 mm.

The overlap distance extending along the axis of the inducer rotor from the leading edges of the blades lies in the range 15% to 20% of the axial length of the blades of the inducer.

BRIEF DESCRIPTION OF THE DRAWINGS

Other characteristics and advantages of the invention appear from the following description of particular embodiments, given as examples and with reference to the accompanying drawings, in which:

FIG. 1 is a diagrammatic view showing an essential characteristic of the invention associated with the shape of the case situated in the vicinity of an inducer rotor;

FIG. 2 is a diagrammatic view similar to FIG. 1, but showing the shape of the case situated in the vicinity of a prior art inducer rotor;

FIG. 3 is an axial section view through an example of a prior art turbopump to which the present invention is applicable;

FIG. 4 is an enlarged axial section view of the inlet portion of the FIG. 3 including the inducer;

FIG. 5 is an end view of the inlet portion of FIG. 4;

FIG. 6 is a curve of $\psi=f(\tau)$ showing the dimensionless pressure rise $\psi$ of the inducer varies as a function of the dimensionless pressure $\tau$ at the inlet of the inducer, for a conventional pump;

DETAILED DESCRIPTION OF PARTICULAR EMBODIMENTS

Figure 7:
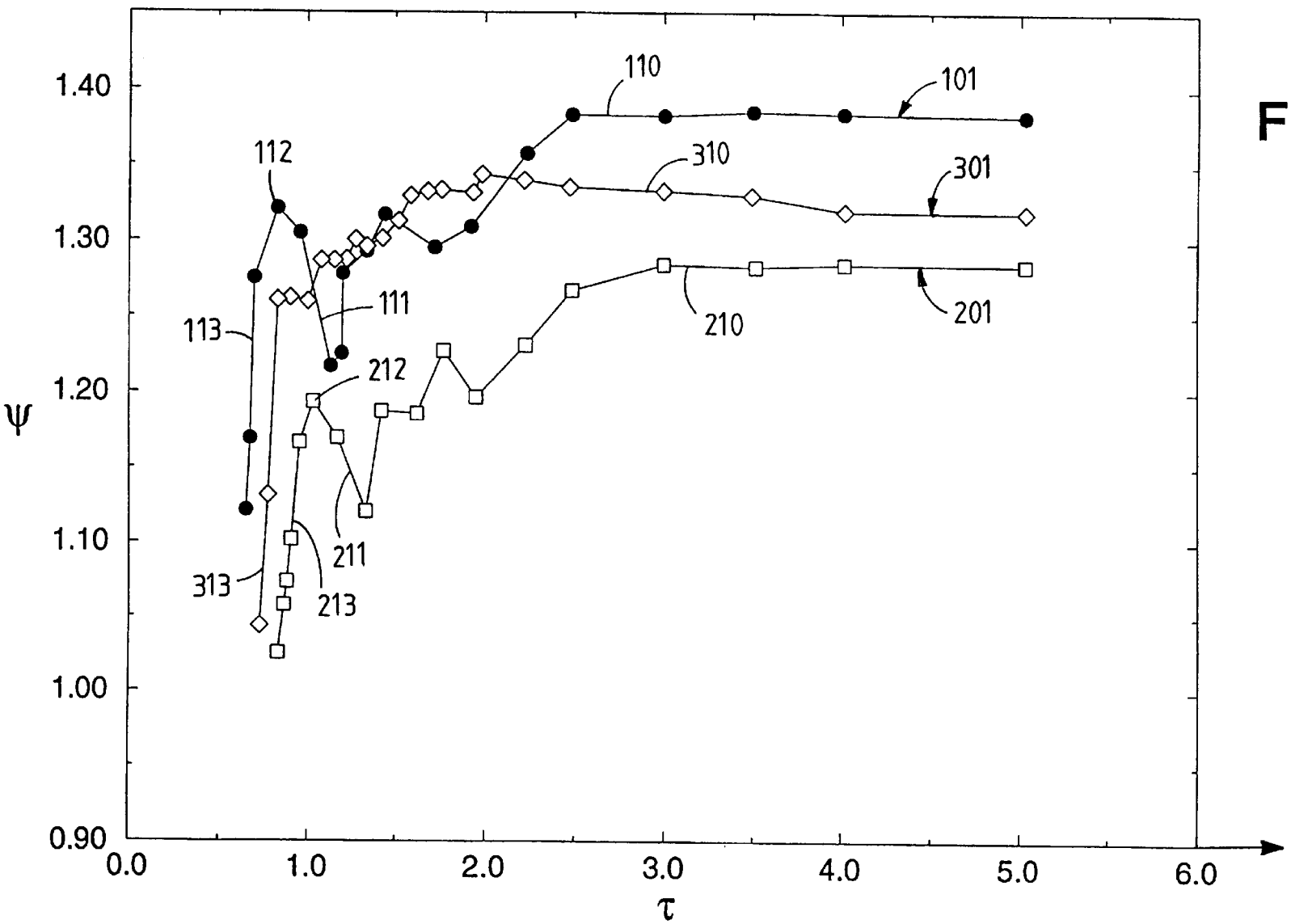
FIG. 7 is a single graph showing three curves of $\psi=f(\tau)$, two of which correspond to prior art inducer equipments and the third of which corresponds to inducer equipment in accordance with the invention.

With reference to FIGS. 3 to 5, there follows a description of an example of known inducer equipment, in particular as disclosed by publication of Japanese patent application No. 5-332 330 (KOKAI), and applied to a large induction-capacity pump 21 such as a turbopump serving to pressurize a propellant being fed to a rocket launcher, e.g. liquid hydrogen.

The large induction-capacity pump 21 has an impeller 29 fixed on a rotary shaft 28 whose rear portion carries one or more wheels 31 of a turbine 30. The shaft 28 is mounted relative to the case of the pump body 32 by means of at least one bearing 33. An inducer rotor 23 is disposed at the front end of the shaft 34 which extends the shaft 28 supporting the impeller 29 and which may coorperate with a bearing 46. The inducer rotor 23 may, for example, comprise a set of three helically-shaped blades 36 mounted on a central element 35 secured to the front end of the shaft 34. As can be seen on FIGS. 3 and 4, the central element 35 serving as a hub of the inducer rotor 23 has a radius whose value increases between the inlet and the outlet of the inducer rotor 23.

Flanges 44 can be provided at the inlet end 39 of the case 24 for fixing to a liquid tank or to a liquid feed pipe. Fixed blades 45 secured to the case 24 may be provided between the inducer rotor 23 and the impeller 29.

In this way, the turbopump 21 shown in FIG. 3 presents inducer equipment 23, 24 placed in conventional manner at the inlet to the pump proper which is provided with its impeller 29, and said inducer equipment is provided with a structure seeking to prevent vibration as provoked by rotary cavitation. For this purpose, the inlet of the case which separates the flow paths of the rotor is provided with an enlarged portion 27 of inside diameter D1, which inside diameter D1 is greater than the inside diameter D2 of the zone 26 surrounding the blades 36 of the rotor 23.

Various comparative tests have shown that such a shape for the case doubtless contributes to reducing supersynchronously rotating cavitation to a small extent, but does not make it possible to completely eliminate the supersynchronous frequency line and the corresponding radial vibration.

The invention goes away from the known case shape of reference as described with reference to FIGS. 2 to 5, and proposes a different case shape which makes it possible to eliminate the supersynchronous frequency line completely and reliably. This new case shape is shown in FIG. 1 which is suitable for comparing with the known shape as illustrated in FIG. 2. It will be observed that the invention relates to improved inducer equipment which can be applied to various types of large induction-capacity pumps, and is therefore not limited to the particular pump structure described by way of example with reference to FIGS. 3 to 5.

In the configuration of FIG. 1, a cylindrical first portion 127 of the inside wall of the case 124 situated upstream from the inducer rotor 123 does indeed have a diameter that is greater than a cylindrical second portion 126 of the inside wall of the case 124 situated in register with the blades 136 of the inducer rotor 123. Nevertheless, a frustoconical transition zone between the first and second cylindrical portions 127 and 126 is not provided (contrary to the zone 43 of FIG. 2), and the cylindrical first portion 127 of the inside wall of the case 124 is itself extended by an additional cylindrical portion 127A of diameter equal to that of the cylindrical portion 127, over a distance d11 from the leading edge of the blades 136, such that increased clearance J12 is defined not only upstream from the inducer rotor 123, but also over a distance d11 overlapping an upstream portion of the inducer rotor 123. In addition, according to another characteristic of the invention which can be combined with the above-described characteristic, the ratio between the increased clearance J12 between the portions 127 and 127A of the inside wall of the case 124 and the periphery of the blades 136 of the inducer, and the normal value clearance J11 between the portion 126 of the inside wall of the case 124 and the periphery of the blades 136 of the inducer is greater than 10. The normal value clearance has a value lying in the range 0.4% to 1% of the radius of the peripheral portion of the inducer blades.

By way of example, the normal value clearance J11 has a value lying in the range 0.4 mm to 0.9 mm, while the increased value clearance J12 has a value lying in the range 5 mm to 10 mm.

Typically, the clearance J11 may be about 0.4 mm while the clearance J12 is about 6 mm.

The overlap distance d11 which extends along the axis of the inducer rotor 23 from the leading edge of the blades 136 can lie in the range 15% to 20% of the axial length of the blades of the inducer.

Thus, regardless of the shape of the leading edge, the supersynchronous frequency line can be eliminated over the entire range of operating flowrates of the inducer, providing the case is given a shape such that the zone of increased clearance overlaps a portion of the rotor over a significant distance d11, and the ratio J12/J11 is large, i.e. greater than 10.

Figure 10:
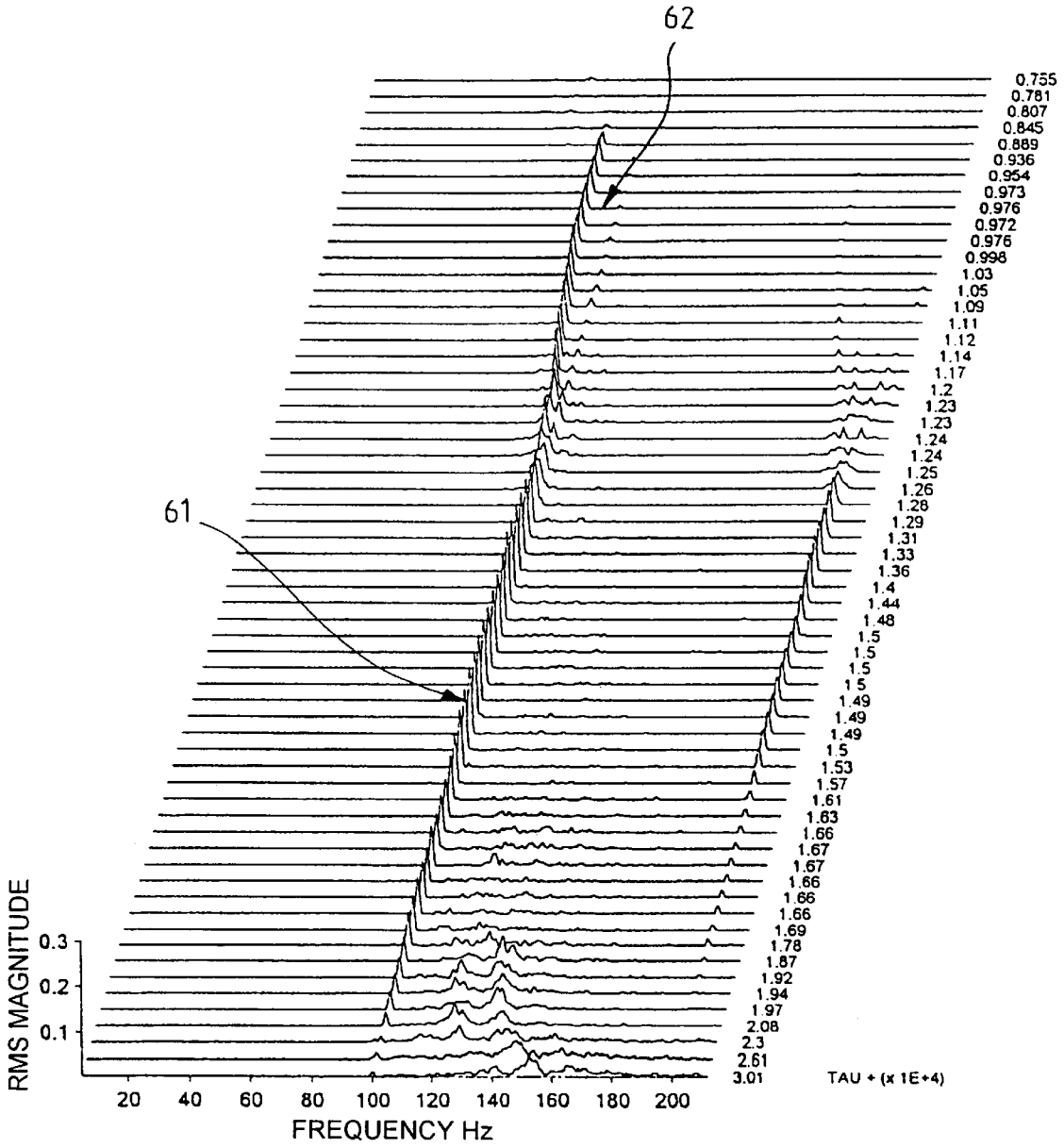
FIG. 10 shows how the characteristic frequency lines vary as a function of dimensionless pressure $\tau$ at the inlet of a similar inducer but fitted with equipment of the invention, having the configuration of FIG. 1, and in which supersynchronous frequency lines have been completely eliminated.

FIG. 10 shows how characteristic frequency lines vary as a function of the inlet pressure $\tau$ of the inducer for a turbopump provided with inducer equipment of the invention. It can be seen that there exists in normal manner a line 61 corresponding to the frequency of rotation $F_0$ of the machine, together, at low pressures, with a subsynchronous line 62. It will be observed that this subsynchronous line 62 which corresponds to subsynchronous cavitation, appears only in a zone defined between low pressures, and therefore does not give rise to the same drawbacks as the supersynchronous frequency lines of known inducers.

Figure 9:
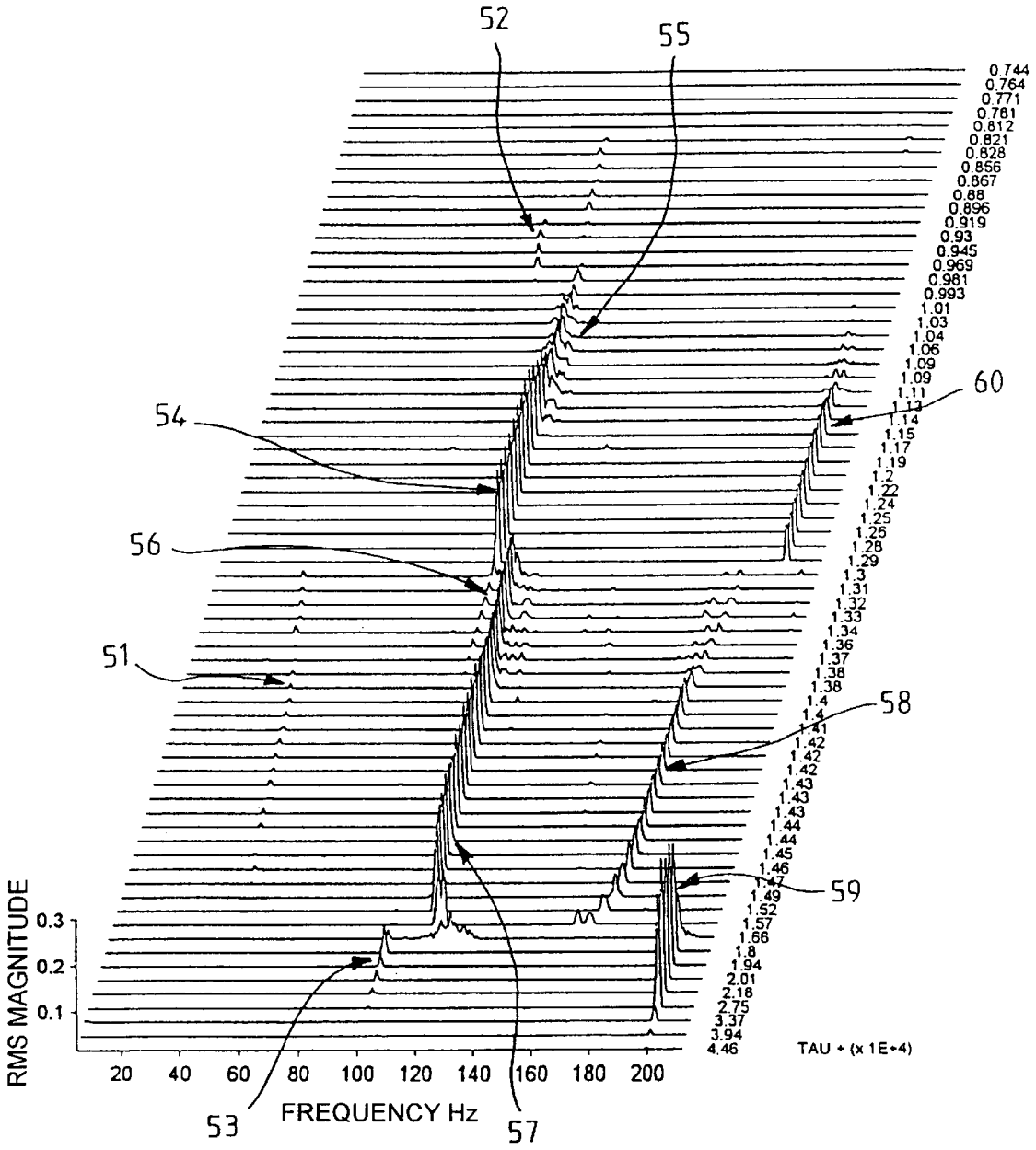
FIG.9 PRIOR ART
FIG. 9 shows how characteristic frequency lines vary as a function of the dimensionless pressure $\tau$ at the inlet of a known conventional inducer, and serves in particular to show the appearance of supersynchronous frequency lines.
Figure 11:
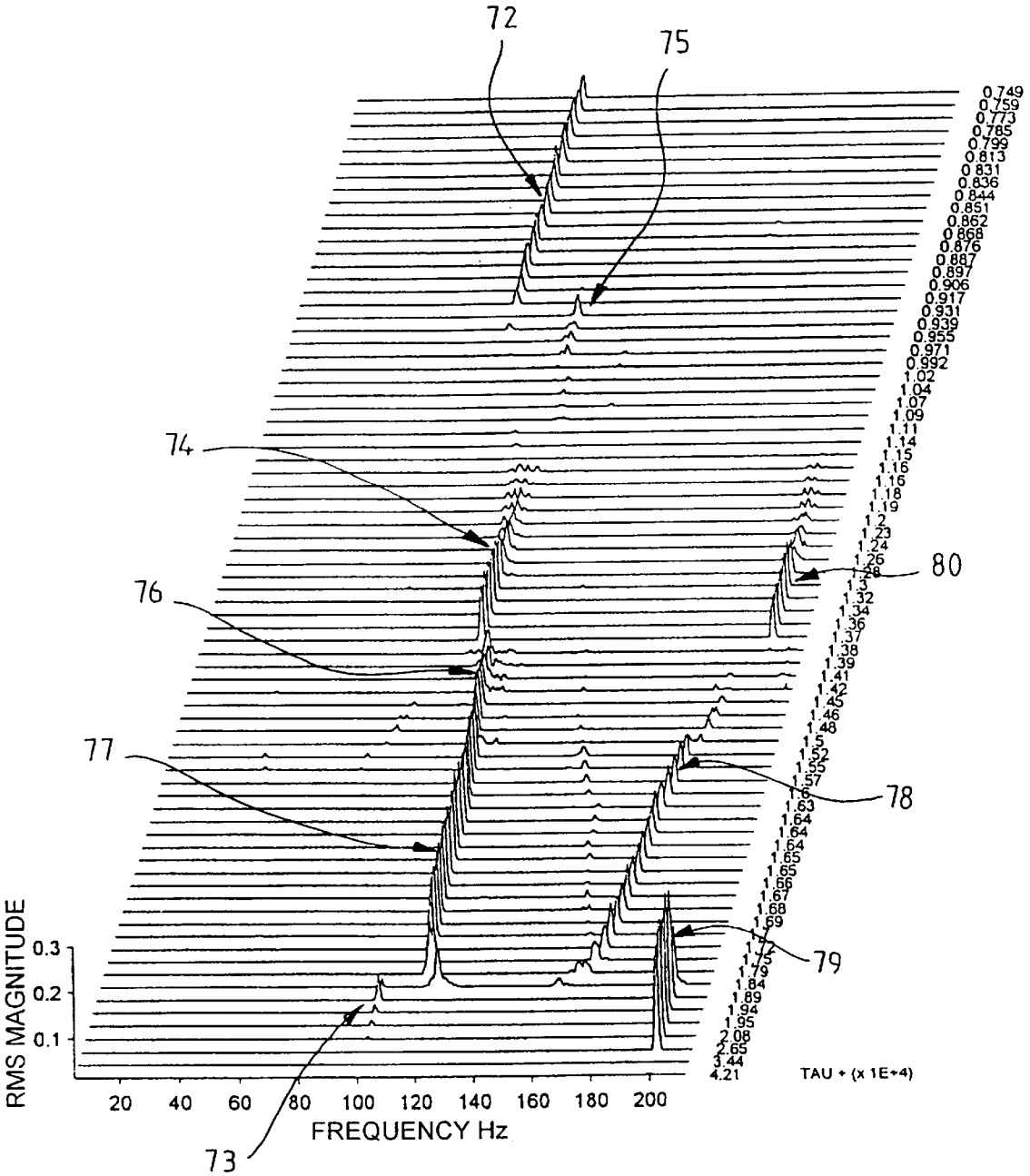
FIG. 11 shows how characteristic frequency lines vary as a function of dimensionless pressure $\tau$ at the inlet of a similar inducer fitted with prior art equipment, such as the equipment shown in FIG. 2, and showing in particular the appearance of supersynchronous frequency lines.

By way of comparison, FIGS. 9 and 11 show how characteristic frequency lines vary as a function of the pressure $\tau$ at the inlet of the inducer, firstly for a turbopump provided with known inducer equipment having normal clearance, and secondly for a turbopump provided with inducer equipment as defined with reference to FIGS. 2 to 5.

In FIG. 9, it can be seen that beside lines 53, 54, and 56 corresponding to the frequency of rotation $F_0$, of the machine, and noise 55 situated around said frequency of rotation $F_0$ there exist numerous other lines corresponding to rotary cavitation phenomena giving rise to the appearance of vibration. Thus, there can be seen a supersynchronous line 57 that is well marked at a frequency $F_s$, of about 1.1 to 1.2 times the frequency of rotation $F_0$. The supersynchronous line 57 is present over a relatively large range of inlet pressures $\tau$ which is particularly troublesome in practice. In FIG. 9, there can also be seen lines 59 and 60 that appear at twice the frequency of rotation $F_0$. Other troublesome lines 51 and 58 corresponding to a combination of the frequency of rotation $F_0$ and the supersynchronous frequency $F_s$ also appear in the diagram of FIG. 9. Thus, the line 51 corresponds to a frequency equal to $4(F_s-F_0)$. There can also be seen a subsynchronous line 52.

In FIG. 11, there can clearly be seen in the same manner, a supersynchronous line 77 in the relatively high and extended inlet pressure range, beside a set of other associated lines 72 to 76 and 78 to 80 which can be analyzed in a manner similar to the analysis provided for the lines 52 to 56 and 58 to 60 in FIG. 9.

On comparing FIG. 10 with FIGS. 9 and 11, it can be seen how much interfering vibration sources are reduced when the casing shape of the invention is implemented.

Also, when considering the curve $\psi=f(\tau)$ of FIG. 7, which curve is established firstly for a turbopump provided with inducer equipment of the invention (curve 301) and also for a turbopump of the prior art having normal clearance (curve 101) and a turbopump having a casing shape of the kind showing FIGS. 2 to 5 (curve 201), it can be seen that both curves 101 and 201 conserve the shape of curve 1 shown in FIG. 6, with, adjacent to a plateau-forming portion 110, 210, a dip 111, 211 followed by a rise 112, 212 preceding a drop 113, 213 on reducing the pressure $\tau$ at the inlet of the inducer.

In contrast, the curve 301 corresponding to inducer equipment of the invention shows that when the pressure $\tau$ at the inlet of the inducer is reduced, then the curve has a plateau 310 which continues without dips or rises down to a small value, prior to the curve dropping off. Thus, there is no longer a zone in which the slope $d\psi/d\tau$ is negative, and this guarantees better stability for the system as a whole comprising the pump and the feed and delivery lines. It is thus the combination of a case cavity defined by the portion 127A and overlapping a portion of the blades 136, in association with a high value for the ratio J12/J11 that makes it possible to cause supersynchronous cavitation to disappear over the entire range of useful flowrates.

Figure 8:
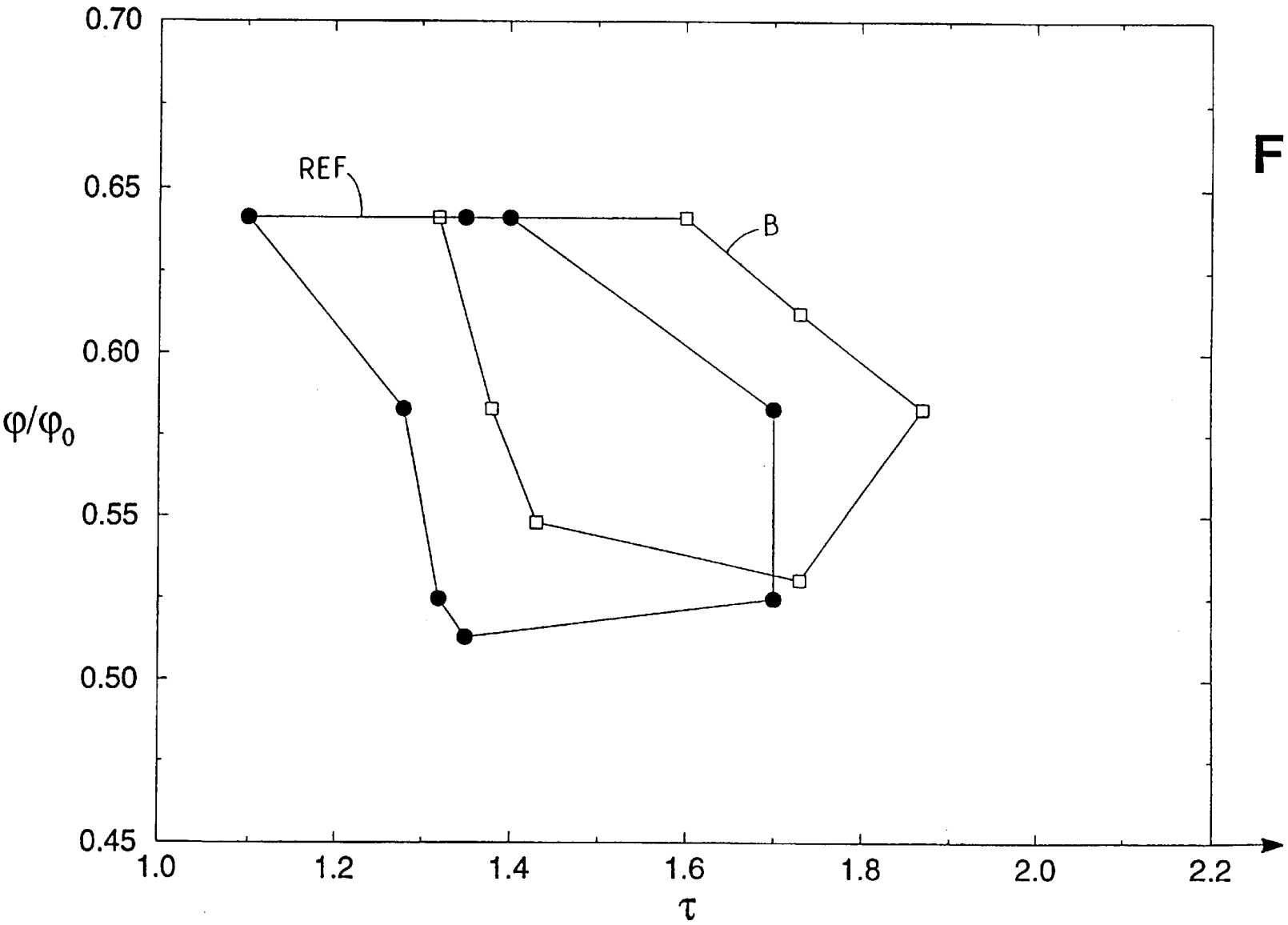
FIG. 8 shows, for various inducers, the field in which the supersynchronous frequency appears in the $(\phi/\phi_0, \tau)$ plane defined by the flowrate coefficient $\phi/\phi_0$ and the pressure $\tau$ at the inlet to the inducer.

If $\phi$ represents the flowrate coefficient of the machine, it can be observed that the supersynchronous cavitation phenomenon is limited in the $(\phi, \tau)$ plane (see FIG. 8).

Thus, when $\tau$ has a high value, there is no or little cavitation (corresponding to the level portions of the curves in FIGS. 6 and 7), and if $\tau$ has a value that is close enough to the acceptable limit for the inducer, then resymmetrization takes place for the various bladed channels of the inducer with strongly developed cavitation that is accompanied by an imminent drop in pressure-raising performance of the inducer (which corresponds to the downward portions of the curves in FIGS. 6 and 7).

In addition, if it is desired to vary the flowrate coefficient $\phi$ of the machine, there appears a minimum flowrate point below which supersynchronous cavitation disappears. Similarly, there exists a maximum flowrate point above which supersynchronous cavitation disappears.

FIG. 8 shows two ranges referenced REF and B which correspond respectively to a casing shape having normal clearance and a casing shape as shown in FIG. 2, for various values of the parameters J1, J2, and d1 as given in Table I below:

| Type of case | J1 (mm) | J2 (mm) | d1 (mm) |
|---|---|---|---|
| REF | 0.4 | 0.4 | — |
| B | 0.64 | 2.0 | 1.28 |

FIG. 8 does not show a field corresponding to an inducer having a casing shape of the invention (FIG. 1) e.g. with the following parameters J11=0.4 mm; J12=6 mm; and d11=12 mm, given that the supersynchronous frequency line has been eliminated.

What is claimed is:

1. Inducer equipment of a large induction-capacity pump including a case surrounding an inducer rotor having a plurality of blades leaving clearance relative to the case, wherein the clearance between the peripheral portion of the blades and the case has an increased value greater than the value of the normal clearance over a zone which extends both over a cylindrical portion of the inside wall of the case upstream from the inducer rotor and over a portion of the inside wall of the case adjacent to said cylindrical portion and covering an upstream portion of the inducer rotor over a distance from the leading edges of the blades of the inducer rotor, and wherein the ratio between the clearance of increased value and the clearance of normal value is greater than 10.

2. Equipment according to claim 1, wherein the clearance of normal value has a value lying in the range 0.4% TO 1% of the greatest radius of the peripheral portions of the inducer rotor.

3. Equipment according to claim 1, wherein the clearance of normal value has a value lying in the range 0.4 mm to 0.9 mm, while the clearance of increased value has a value lying in the range 5 mm to 10 mm.

4. Equipment according to claim 1, wherein the overlap distance extending along the axis of the inducer rotor from the leading edges of the blades lies in the range 15% to 20% of the axial length of the blades of the inducer.

* * * * *

UNITED STATES PATENT AND TRADEMARK OFFICE

CERTIFICATE OF CORRECTION

PATENT NO. : 6,065,929
DATED : May 23, 2000
INVENTOR(S) : Philippe Morel, et al.

It is certified that error appears in the above-identified patent and that said Letters Patent is hereby corrected as shown below:

Title page,
Item [30], "Apr. 7, 1997" should read -- Jul. 4, 1997 --.

Signed and Sealed this

Thirtieth Day of October, 2001

*Attest:*

Nicholas P. Godici

NICHOLAS P. GODICI
*Acting Director of the United States Patent and Trademark Office*

*Attesting Officer*